United States Patent [19]

Richter

[11] 4,423,833

[45] Jan. 3, 1984

[54] REFRACTORY IMMERSION SPOUT

[75] Inventor: Werner Richter, Krefeld, Fed. Rep. of Germany

[73] Assignee: Didier-Werke A.G., Wiesbaden, Fed. Rep. of Germany

[21] Appl. No.: 337,273

[22] Filed: Jan. 5, 1982

[30] Foreign Application Priority Data

Jan. 16, 1981 [DE] Fed. Rep. of Germany ..... 3101219

[51] Int. Cl.[3] ..... B22D 41/08

[52] U.S. Cl. ..... 222/591; 222/606; 164/437

[58] Field of Search ..... 222/590, 591, 566, 567, 222/606; 164/337, 437

[56] References Cited

U.S. PATENT DOCUMENTS

| | | | |
|---|---|---|---|
| 4,210,264 | 7/1980 | Kondo | 222/591 |
| 4,257,473 | 3/1981 | Mills | 164/437 X |

FOREIGN PATENT DOCUMENTS

| | | | |
|---|---|---|---|
| 2446165 | 3/1977 | Fed. Rep. of Germany . | |
| 54-155124 | 12/1979 | Japan | 164/437 |
| 55-54244 | 4/1980 | Japan | 164/437 |
| 55-165274 | 12/1980 | Japan | 222/591 |
| 57-42571 | 3/1982 | Japan | 222/591 |
| 57-42576 | 3/1982 | Japan | 222/591 |

*Primary Examiner*—David A. Scherbel

*Attorney, Agent, or Firm*—Wenderoth, Lind & Ponack

[57] ABSTRACT

A refractory immersion spout includes a spout member having an upper portion and a lower portion. The spout member has a pouring channel and outlet openings extending laterally from the pouring channel. A refractory sleeve covers the outer surface of at least a portion of the lower portion of the spout member. The spout member comprises an extrusion product resulting from the extrusion of a material including 30–75% alumina and 10–30% carbon, with the carbon being aligned longitudinally of the spout member as a result of the extrusion. The sleeve comprises an isostatically compressed member formed of a highly refractory material. The thickness of the lower portion of the spout member is less than the thickness of the upper portion of the spout member, such reduction in thickness resulting from a reduction of the outer size of the spout member. The sleeve is cemented onto the outer surface of the lower portion of the spout member by an alumina-rich refractory cement.

4 Claims, 3 Drawing Figures

REFRACTORY IMMERSION SPOUT

BACKGROUND OF THE INVENTION

The present invention relates to an improved refractory immersion spout for the continuous casting of a metal melt, particularly a steel melt, from an intermediate container into an ingot mold, the immersion spout being of the type including a refractory spout member having an upper portion adapted to be connected to an intermediate container and a lower portion adapted to be at least partially immersed in a melt bath, the spout member having a pouring channel and outlet openings extending laterally from the pouring channel at a level adapted to be below the level of a slag-covered upper surface of the melt bath, and a refractory sleeve covering the outer surface of at least that part of the lower portion of the spout member adapted to be immersed in the melt bath.

This general type of immersion spout is disclosed in DE-AS No. 24 46 165, wherein a refractory sleeve is fastened to the spout member by means of pins. This sleeve is intended to protect the spout from premature wear and to obtain favorable flow conditions for streams of metal flowing into the ingot mold.

Generally, the service life of an immersion spout depends firstly and essentially on its resistance to chemical and erosive attacks effected on the outer surface of the immersion spout, particularly at the area of the bath level, by the metal melt and the slag formed on the upper surface thereof. The service life of an immersion spout further depends on the extent to which the melt flowing through the immersion spout has an abrasive effect on the interior surface of the spout and whether, particularly with aluminum killed steels, $Al_2O_3$ deposits (deoxidation products) are formed which may plug the passage or pouring channel of the spout and may result ultimately in a discontinuation of the pouring process. Known measures to counteract wear, on the one hand, and plugging of the cross section of the flow channel, on the other hand, tend to be mutually exclusive. That is, steps which may be taken for increasing wear resistance tend to result in increased alumina deposits causing plugging of the pouring channel, and vice versa.

SUMMARY OF THE INVENTION

With the above discussion in mind, it is an object of the present invention to provide an improved refractory immersion spout which overcomes the above discussed and other prior art disadvantages.

It is a further object of the present invention to provide such a refractory immersion spout which prevents plugging of the internal pouring channel and which at the same time has a high degree of resistance to outer chemical and erosive attacks.

The above advantages are achieved in accordance with the present invention by the provision of a refractory immersion spout for the continuous casting of a metal melt, particularly a steel melt, from an intermediate container into an ingot mold, the immersion spout including a refractory spout member having an upper portion adapted to be connected to an intermediate container and a lower portion adapted to be at least partially immersed in a melt bath, the spout member having a pouring channel and outlet openings extending laterally from the pouring channel at a level adapted to be below the level of a slag-covered upper surface of the melt bath, and a refractory sleeve covering the outer surface of at least that part of the lower portion of the spout member adapted to be immersed in the melt bath. In accordance with the present invention, the spout member comprises a product resulting from the plastic manufacture, particularly by extrusion, of a material including 30–70% alumina and 10–30% carbon, with the carbon being aligned in plates longitudinally of the spout member as a result of the plastic manufacturing process. That is, the carbon within the material from which the spout member is formed is aligned during plastic formation of the spout member, for example preferably by extrusion, such that heat distribution within the pouring channel of the spout member is so even and uniform that plugging of the pouring channel cross-section with deoxidation products is prevented. Any insignificant deposits which may be permitted to occur repeatedly are continuously flushed away through the pouring channel in the spout member by the stream of melt passing therethrough. Thus, the carbon in plate form elongated in the direction of the pouring channel during the extrusion forming of the spout member results in heat conduction along the longitudinal direction of the pouring channel.

In accordance with a further feature of the present invention, the sleeve comprises an isostatically compressed member formed of a highly refractory material. Since the material of the sleeve is isostatically compressed, it becomes exceptionally dense. The sleeve therefore provides a high degree of protection of the outer circumference of the immersion spout against chemical and erosive influence. The highly refractory material of the sleeve may preferably comprise zirconium oxide. In accordance with a further feature of the invention, the highly refractory material of the sleeve, in the area thereof adapted to be contacted by the slag on the top of the melt bath, may include 5–20% boron nitride. This provides particular resistance to the chemical and erosive effects of the slag.

In accordance with a further feature of the invention, the thickness of the lower portion of the spout member is less than the thickness of the upper portion of the spout member. This reduction in thickness results from removal of material from the outer size or circumference of the spout member, i.e. from a reduction of the outer size of the spout member. Accordingly, attachment of the sleeve to this reduced outer size lower portion of the spout member presents a construction which has substantially no lateral projecting portions which may interfere with operation of the system.

In accordance with a further feature of the present invention, the sleeve is cemented onto the outer surface of the lower portion of the spout member by an alumina-rich refractory cement, for example a refractory cement having at least 70% alumina. The dimensions of the lower portion of the spout member and the sleeve are such that the sleeve is essentially pressure attached to the lower portion of the spout member by the cement, which may be chemically bonding. The sleeve may include a bottom having therein at least one bore for discharge therethrough of excessive cement during attachment of the sleeve to the lower portion of the spout member. This arrangement provides an advantage by eliminating the need for pins or plugs for attachment of the sleeve, as is common in the prior art.

Percentages employed herein are understood to be weight percentages.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
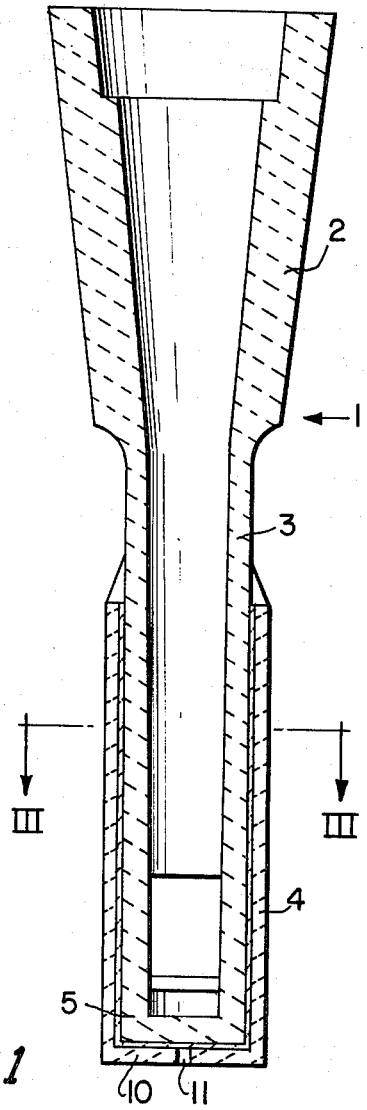
FIG. 1 is a longitudinal section through a refractory immersion spout according to the present invention, taken along a small diameter of a pouring channel of a generally elliptical cross-section.
Figure 2:
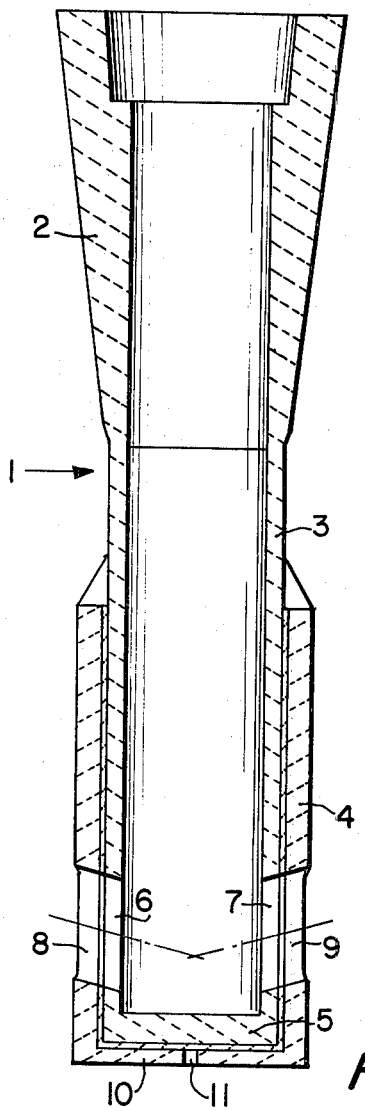
FIG. 2 is a longitudinal section similar to FIG. 1, but taken along a large diameter of the pouring channel.
Figure 3:
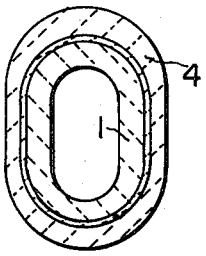
FIG. 3 is a transverse section taken along line III—III of FIG. 1.

The drawings illustrate a preferred embodiment of a refractory immersion spout according to the present invention. The immersion spout includes a refractory spout member 1 having an upper portion 2 adapted to be connected to an intermediate container (not shown) and a lower portion 3 adapted to be at least partially immersed in a melt bath (not shown). The spout member 1 has extending longitudinally therethrough a pouring channel, and outlet openings 6, 7 extend laterally from the pouring channel at a level adapted to be below the level of a slag-covered upper surface of the melt bath. Preferably, outlet openings 6, 7 may be directed upwardly. The spout member has a bottom 5 closing the pouring channel. As will be apparent from the drawings, the pouring channel has a generally oval or elliptical cross section, and the outlet openings 6, 7 extend through the smaller sides of the elliptical wall of lower portion 3 of the spout member.

The spout member 1 is formed of a material including 30–75% alumina and 10–30% carbon. This material is subjected to a plastic manufacturing operation to form the spout member 1, and preferably this plastic forming operation is an extrusion operation. By this extrusion, the carbon particles are aligned in directions longitudinally of the spout member. This alignment of carbon "plates" created during the extrusion forming of the spout member 1 results in a uniform and rapid heat conduction along the longitudinal direction of the walls forming the pouring channel. This prevents plugging of the channel cross section with deoxidation products such as alumina, while allowing insignificant deposits which are continuously flushed through the pouring channel by the melt stream to occur repeatedly.

A sleeve 4 is attached to the outer circumference of the lower portion 3, at least that portion thereof adapted to be immersed in a melt bath. In accordance with the present invention, the sleeve 4 is formed of a highly refractory material which is isostactically compressed and therefore exceptionally dense. Such sleeve thereby provides a high degree of protection of the immersed area of the spout member against chemical and erosive influences of the melt and of the slag on top of the melt. The highly refractory material of the sleeve 4 may be any refractory material known by those skilled in the art to be highly refractory and resistant to chemical and erosive attack by the liquid melt and the slag thereon. One particularly preferred material is zirconium oxide. In accordance with a further feature of the present invention that area of the sleeve 4 adapted to be contacted by slag on the top of the melt bath may include 5–20% boron nitride. The sleeve 4 has openings 8, 9 adapted to align with outlet openings 6, 7 of the spout member.

In accordance with a further feature of the present invention, the sleeve 4 is cemented onto the outer surface of the lower portion 3 of the spout member 1 by an alumina-rich refractory cement. Those skilled in the art will understand the types of cement which may be employed, and a preferable such cement includes over 70% $Al_2O_3$. The cementing of the sleeve onto the lower portion of the spout member provides for rigid attachment without the need for pins or plugs as are common in the prior art.

A yet further feature of the present invention involves the exterior configuration of the spout member 1. Thus, the upper portion 2 has a larger diameter in size than the lower portion 3. Thus, although the major dimension of the pouring channel is continuous throughout the spout member 1, the wall thickness of the lower portion 3 is less than the wall thickness of upper portion 2. This is achieved by a removal of material from the outer surface of the lower portion 3 or a reduction of the outer size of the lower portion 3. Thereby, when the sleeve 4 is cemented onto the lower portion 3, there are no substantial lateral projections extending outwardly which may interfere with operation of the system. Upper portion 2 may have a generally conical configuration as shown.

The sleeve 4 may have a bottom 10 having therein at least one bore 11 for the discharge therethrough of excess cement during the attachment of the sleeve 4 to the lower portion 3 of the spout member. It is to be understood that when the sleeve is attached to the spout member, both the sleeve and the spout member are fired and otherwise completed.

Although the present invention has been described and illustrated with regard to a preferred embodiment thereof, various modifications and alterations may be made to the specifically described and illustrated embodiment without departing from the scope of the present invention. Specifically, it is believed that those skilled in the art will understand the types of materials which may be employed for the sleeve, the spout member and the cement, such materials being refractory materials capable of achieving the above discussed functions in a particular melt environment.

What is claimed is:

1. In a refractory immersion spout for the continuous casting of a metal melt from an intermediate container into an ingot mold, said immersion spout being of the type including a refractory spout member including an upper portion adapted to be connected to an intermediate container and a lower portion adapted to be at least partially immersed in a melt bath, said spout member having a pouring channel and outlet openings extending laterally from said pouring channel at a level adapted to be below the level of a slag-covered upper surface of the melt bath, and a refractory sleeve covering the outer surface of at least that part or said lower portion of said spout member adapted to be immersed in the melt bath, the improvement comprising:

said spout member comprising an extrusion product resulting from the extrusion of a material including 30–75% alumina and 10–30% carbon, with said carbon being aligned longitudinally of said spout member as a result of said extrusion;

said sleeve comprising an isostactically compressed member formed of a highly refractory material;

the thickness of said lower portion of said spout member being less than the thickness of said upper portion of said spout member, said reduction in thickness resulting from a reduction of the outer size of said spout member; and said sleeve being cemented onto the outer surface of said lower portion of said spout member by an alumina-rich refractory cement.

2. The improvement claimed in claim 1, wherein said highly refractory material of said sleeve comprises zirconium oxide.

3. The improvement claimed in claim 1 or claim 2, wherein said highly refractory material of said sleeve, in the area thereof adapted to be contacted by slag on the top of the melt bath, includes 5–20% boron nitride.

4. The improvement claimed in claim 1, wherein said sleeve includes a bottom having therein at least one bore for discharge therethrough of excess cement during attachment of said sleeve to said lower portion of said spout member.

* * * * *